US007210192B2

(12) United States Patent
Ito et al.

(10) Patent No.: US 7,210,192 B2
(45) Date of Patent: May 1, 2007

(54) VACUUM CLEANER HAVING A SLANTED PEDESTAL

(75) Inventors: Koichi Ito, Shiga (JP); Hiroshi Nishimura, Shiga (JP)

(73) Assignee: Matsushita Electric Industrial Co., Ltd. (JP)

( * ) Notice: Subject to any disclaimer, the term of this patent is extended or adjusted under 35 U.S.C. 154(b) by 448 days.

(21) Appl. No.: 10/430,222

(22) Filed: May 7, 2003

(65) Prior Publication Data

US 2003/0208875 A1 Nov. 13, 2003

(30) Foreign Application Priority Data

May 8, 2002 (JP) ..... 2002-132690
Jun. 14, 2002 (JP) ..... 2002-173748

(51) Int. Cl.
*A47L 9/10* (2006.01)
*A47L 9/26* (2006.01)

(52) U.S. Cl. ..... 15/327.7; 15/323; 15/352; 55/DIG. 3

(58) Field of Classification Search ..... 15/323, 15/327.7, 352, 327.2; 55/429, DIG. 3
See application file for complete search history.

(56) References Cited

U.S. PATENT DOCUMENTS 2,233,167 A * 2/1941 Holm-Hansen ..... 15/323
2,937,395 A * 5/1960 Meyerhoefer ..... 15/323
3,621,640 A * 11/1971 Ohno et al. ..... 15/327.7
3,816,983 A * 6/1974 Sawada et al. ..... 15/327.7
4,924,039 A * 5/1990 McAllise et al. ..... 15/323
6,256,834 B1 * 7/2001 Meijer et al. ..... 15/352
6,484,350 B2 * 11/2002 Yung ..... 15/352
6,524,358 B2 * 2/2003 Yang ..... 55/337
6,818,036 B1 * 11/2004 Seaman ..... 15/327.7

FOREIGN PATENT DOCUMENTS

JP 6215207 4/1987

* cited by examiner

*Primary Examiner*—Theresa T. Snider
(74) *Attorney, Agent, or Firm*—Bacon & Thomas PLLC

(57) ABSTRACT

A vacuum cleaner has a suction air inlet disposed in front of an electric blower and a dust chamber detachably installed to the rear of the electric blower. The vacuum cleaner further embodies a swivel caster and wheels for facilitating transportability thereof, wherein the swivel caster is provided in front of the electric blower. By not having the dust chamber above the swivel caster, regardless of the amount of dust accumulated in the dust chamber, the load that is distributed on the swivel caster stays substantially unchanged, thereby enhancing durability of the swivel caster. Furthermore, in such configuration loading and unloading of the dust chamber can be carried out without being interfered with a hose due to the placement of the suction air outlet connected with the hose and the dust chamber on opposite ends of the vacuum cleaner.

12 Claims, 11 Drawing Sheets

VACUUM CLEANER HAVING A SLANTED PEDESTAL

FIELD OF THE INVENTION

The present invention relates to a vacuum cleaner.

BACKGROUND OF THE INVENTION

Conventional vacuum cleaners in general are as disclosed in Japanese Patent Laid-Open Publication No. 1987-15207 as illustrated in FIG. 13.

Referring to FIG. 13, there is provided main body 1 of a vacuum cleaner. Included in a rear region thereof is electric blower 2 for the generation of suction air flow for the intake of dust. Electric blower 2 communicates with a suction nozzle (not shown) for suctioning dirt-laden air. Included in a front region of main body 1 is dust chamber 5 incorporating main filter 3 for filtering fine dust particles and pre-filter 4 for entrapping large dust particles. Dust chamber 5 in air communication with electric blower 2 is detachably installed in main body 1.

Provided in front of dust chamber 5 is suction air inlet 6 communicating therewith for introducing dirt-laden air into main body 1. In order to facilitate transportability of main body 1, there are provided a pair of wheels 7 in a rear portion of lateral faces thereof and swivel caster 8 on a bottom surface thereof below dust chamber 5.

Under such a conventional configuration, the dust particles that travel through suction air inlet 6 are accumulated in dust chamber 5, and therefore, a substantial accumulation of dust particles in dust chamber 5 places substantial load on swivel caster 8, and consequently making swivel caster 8 and a portion of main body 1 that securely holds swivel caster 8 vulnerable to damages after repeated impacts thereto.

Moreover, such a configuration further suffers from creating inconvenience to the user when detaching dust chamber 5. More specifically, components of the vacuum cleaner, e.g., a hose (not shown) and a suction nozzle (not shown), which are connected with suction air inlet 6 located in front of dust chamber 5, interfere with user's unloading of dust chamber 5 from main body 1.

SUMMARY OF THE INVENTION

It is, therefore, a primary object of the present invention to provide a vacuum cleaner capable of enhancing durability and reliability of a swivel caster employed therein.

It is, therefore, another object of the present invention to provide a vacuum cleaner employing a dust chamber capable of facilitating detachability thereof.

In accordance with a preferred embodiment of the present invention, there is provided a vacuum cleaner, including: an electric blower for generating suction air stream; a suction air inlet placed in front of the electric blower serving as an inlet of the suction air stream into a main body; a detachable dust chamber disposed to the rear of the electric blower; and a swivel caster and wheels for transporting the main body, wherein the swivel caster is placed in front of the electric blower.

In accordance with another preferred embodiment of the present invention, there is provided a vacuum cleaner, including: a main body having an electric blower for generating suction air stream, a dust chamber placed behind the electric blower, forming at least a part of a rear outer perimeter of the main body; and a pedestal having a descending slant toward a front portion of the main body, wherein the bottom surface of the dust chamber formed with the main body is detachably supported on the pedestal.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENT

Figure 1:
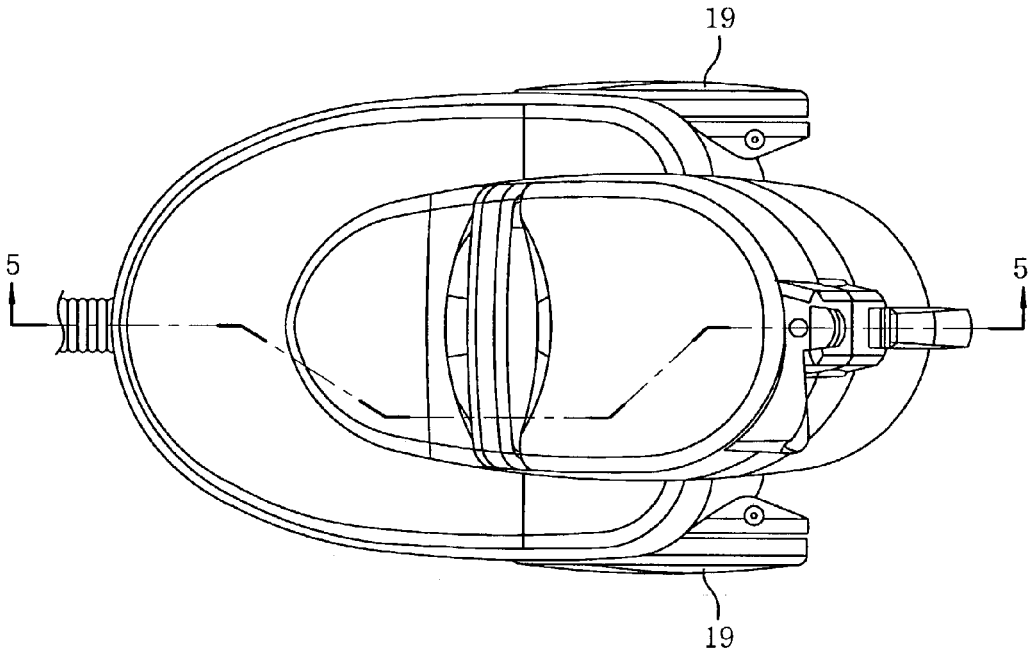
FIG. 1 is a plan view of a main body of a vacuum cleaner in accordance with a first preferred embodiment of the present invention.

A first preferred embodiment will now be described with reference to FIGS. 1 to 9, in which there is provided main body 10 incorporating therein electric blower 11 for generating suction air for the intake of dust via hose 12. Hose 12 is detachably secured to suction air inlet 13 located in a front portion of main body 10, while being placed in front of electric blower 11. Detachably placed in a rear portion of main body 10 at the back of electric blower 11 is substantially cylindrical dust chamber 14 making up parts of the rear outer walls of main body 10 for collecting and storing dust therein.

The dirt-laden air is suctioned and travels from suction air inlet 13 through suction air path 15 and into substantially cylindrical dust chamber 14, at which time the dust is filtered by filter 16, and subsequently, only the air free of dust leaves therefrom. The filtered dust is accumulated in dust chamber 14, whereas the dust-free air travels to electric blower 11 through air passage 17.

Swivel caster 18 having rotatable roller 18*a* is rotatably installed on a front bottom surface of main body 10 between suction air inlet 13 and electric blower 11. Furthermore, a pair of wheels 19 are rotatably installed to the lateral faces of the rear portion of main body 10.

Above dust chamber 14, there is provided cord retracting chamber 21 that is tilted toward suction air inlet 13, for storing therein electrical power cord 20.

Hereinafter, an operation of the vacuum cleaner described above will now be explained in detail.

Figure 5:
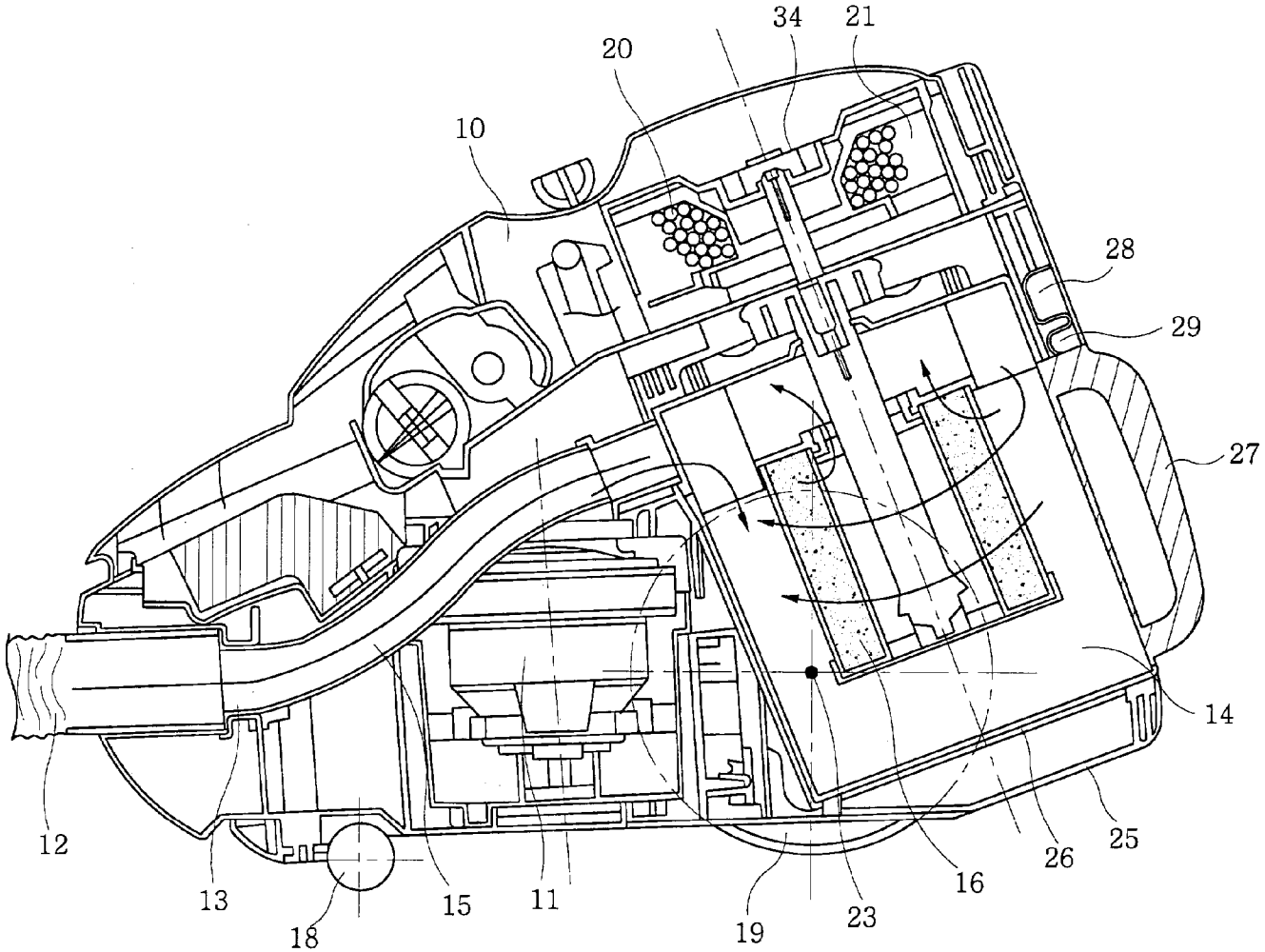
FIG. 5 is a cross sectional view of the main body of the vacuum cleaner cutting through the line 5—5 in FIG. 1.

Referring to FIG. 5, when the vacuum cleaner is in use, the dirt suctioned through hose 12 travels through suction air path 15 to be collected in the bottom of dust chamber 14. In such configuration, wherein dust chamber 14 is spaced apart from swivel caster 18, the effect of the amount of dust accumulated in dust chamber 14 on caster 18 is mitigated. Moreover, since swivel caster 18 is placed in front of electric blower 11 between electric blower 11 and suction air inlet 13, there is a significant reduction in the distribution of the weight of electric blower 11 on swivel caster 18, and thereby reducing the overall load that acts on swivel caster 18. Accordingly, durability of the vacuum cleaner is enhanced, because by reducing the load that acts on swivel caster 18, damages, which may incur upon impact on swivel caster 18 and/or on a portion of main body 10 that securely holds swivel caster 18 can be effectively eliminated.

Furthermore, such configuration significantly reduces load concentration of the collected dust on swivel caster 18, and thereby improving the maneuverability of the vacuum cleaner on carpet.

The axis of rotation 23 of wheels 19 is located in dust chamber 14, in front of central axis 22 thereof, so that the center of dust chamber 14 is positioned behind wheels 19. Therefore, the load of dust chamber 14 distributed to swivel caster 18 is significantly reduced, and further, the distance between swivel caster 18 and dust chamber 14 is increased, enabling to further reduce the load that acts on swivel caster 18.

Figure 6:
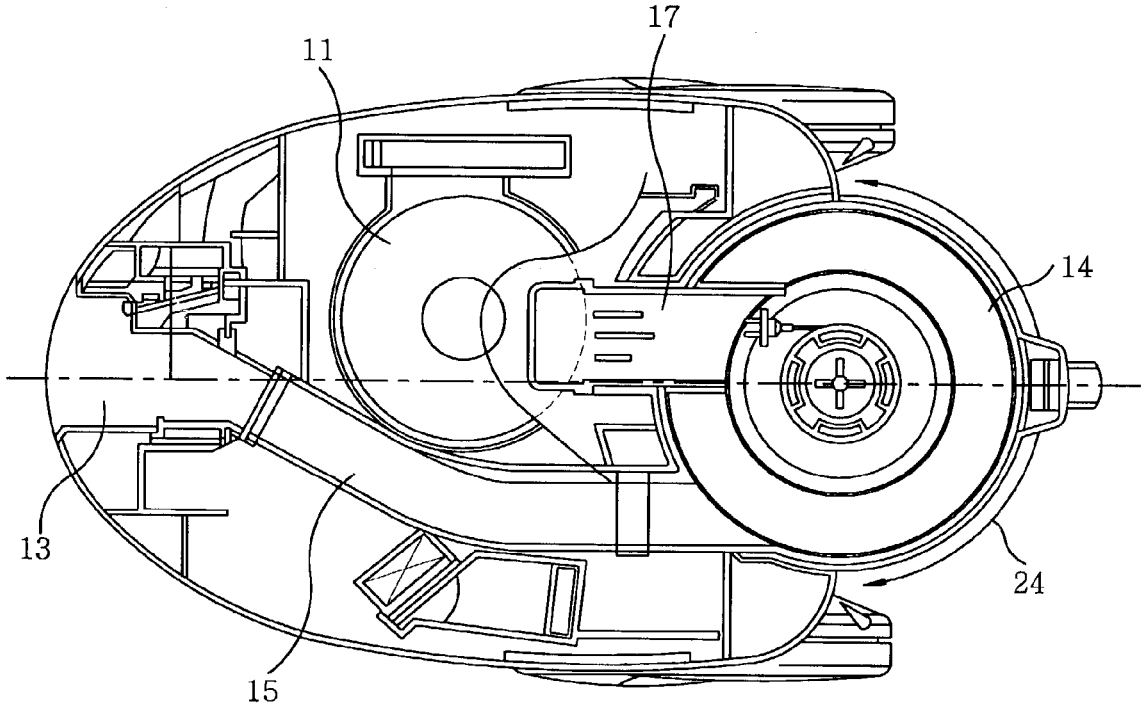
FIG. 6 provides a horizontal sectional view of the main body of the vacuum cleaner illustrating a suction air-stream path.

Referring to FIG. 6, substantially cylindrical dust chamber 14 that is placed in the rear portion of main body 10 is formed of a transparent or a semi-transparent material. Furthermore, approximately a half of outer perimeter 24 of substantially cylindrical dust chamber 14 as indicated by the arrow is exposed to the outside to thereby make up a part of the outer perimeter of main body 10, so that the operator of the vacuum cleaner can observe the level of dust contained therein, making the product more user-friendly.

Figure 7:
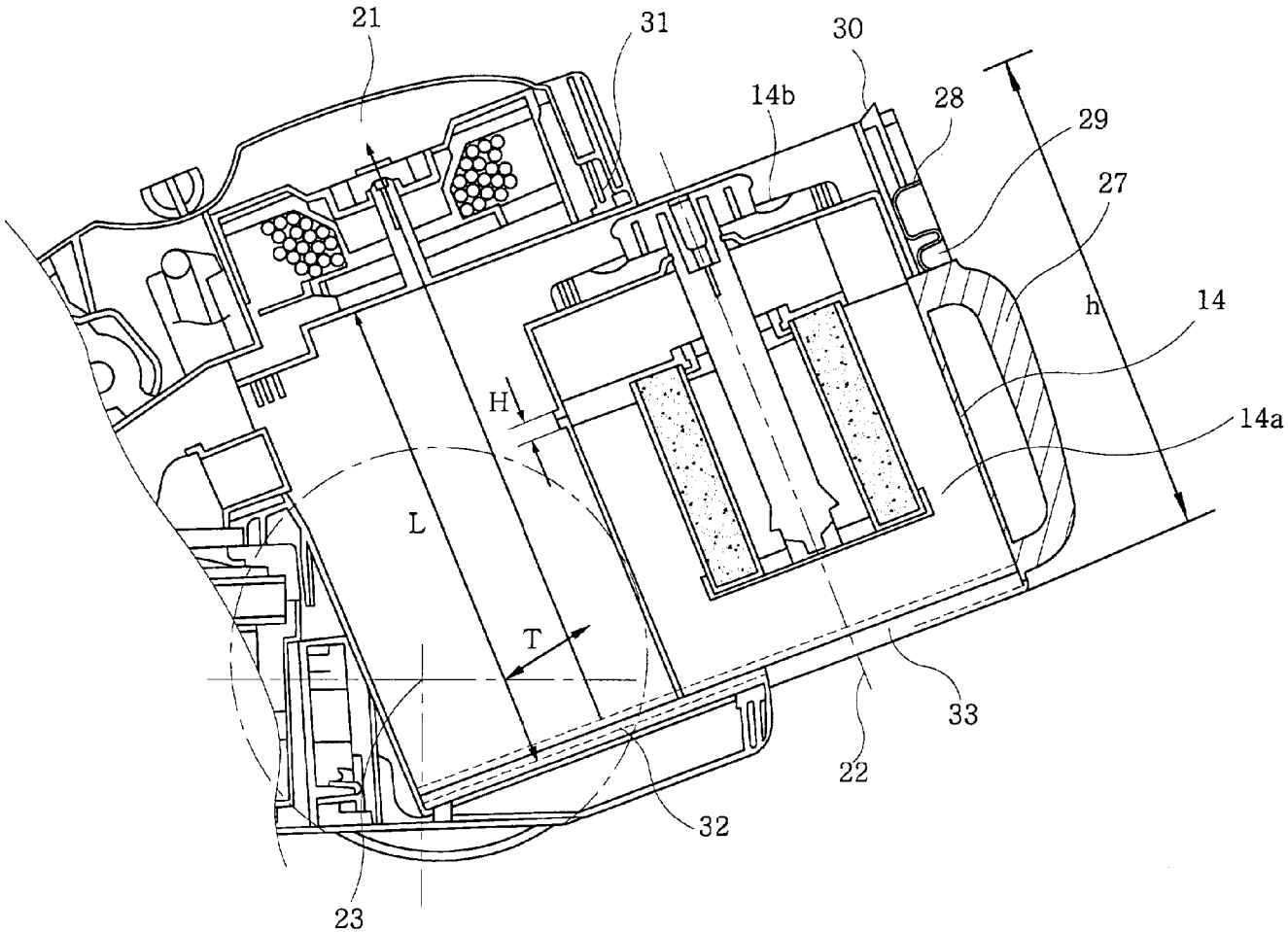
FIG. 7 presents a partial cross sectional view of a rear portion of the main body of the vacuum cleaner.

Referring to FIGS. 5 and 7, support 25, which is formed in the rear portion of main body 10 in order to support the bottom surface of dust chamber 14, is shaped substantially similar to outer perimeter 24 of dust chamber 14. Surfaces of support 25 that face a surface on which the main body 1 resides, e.g., floor, (hereinafter referred to as the floor, however not limited to the floor in practice), and dust chamber 14 are elevated in the rear with respect to the floor; that is the surfaces are slanted forming a decline toward suction air inlet 13, serving as pedestal 26 for hosting dust chamber 14.

Handle 27 is provided at the back side of dust chamber 14, and provided on top of handle 27 is clamp 28. Seamlessly formed with the lower end of clamp 28 is clamp spring 29 of an approximate c-shape, enabling a vertical sliding motion.

Furthermore, protruding portion 30 is formed on top of clamp 28 to be detachably inserted into or mated with recess 31 provided in cord retracting chamber 21 that is disposed above dust chamber 14, allowing dust chamber 14 to be secured in main body 10. By simply placing dust chamber 14 on pedestal 26, dust chamber 14 can be slidably inserted in place by its own weight in the direction of an arrow, and thus can be easily mounted in main body 10, thereby lessening the labor required in restoring dust chamber 14 into main body 10 and thus providing greater convenience to the user. The forwardly tilted configuration of support 25 enables the exposed outer perimeter of dust chamber 14 to be viewed rather easily by the user, thereby facilitating the observation of the dust collected therein. Moreover, since dust chamber 14 is held by protruding portion 30 of clamp 28 engaged with recess 31 provided at a lower surface of cord retracting chamber 21, clamp 28 is accessible with a thumb while gripping handle 27, and therefore clamp 28 can be triggered with a thumb to disengage dust chamber 14 from main body 10.

Figure 3:
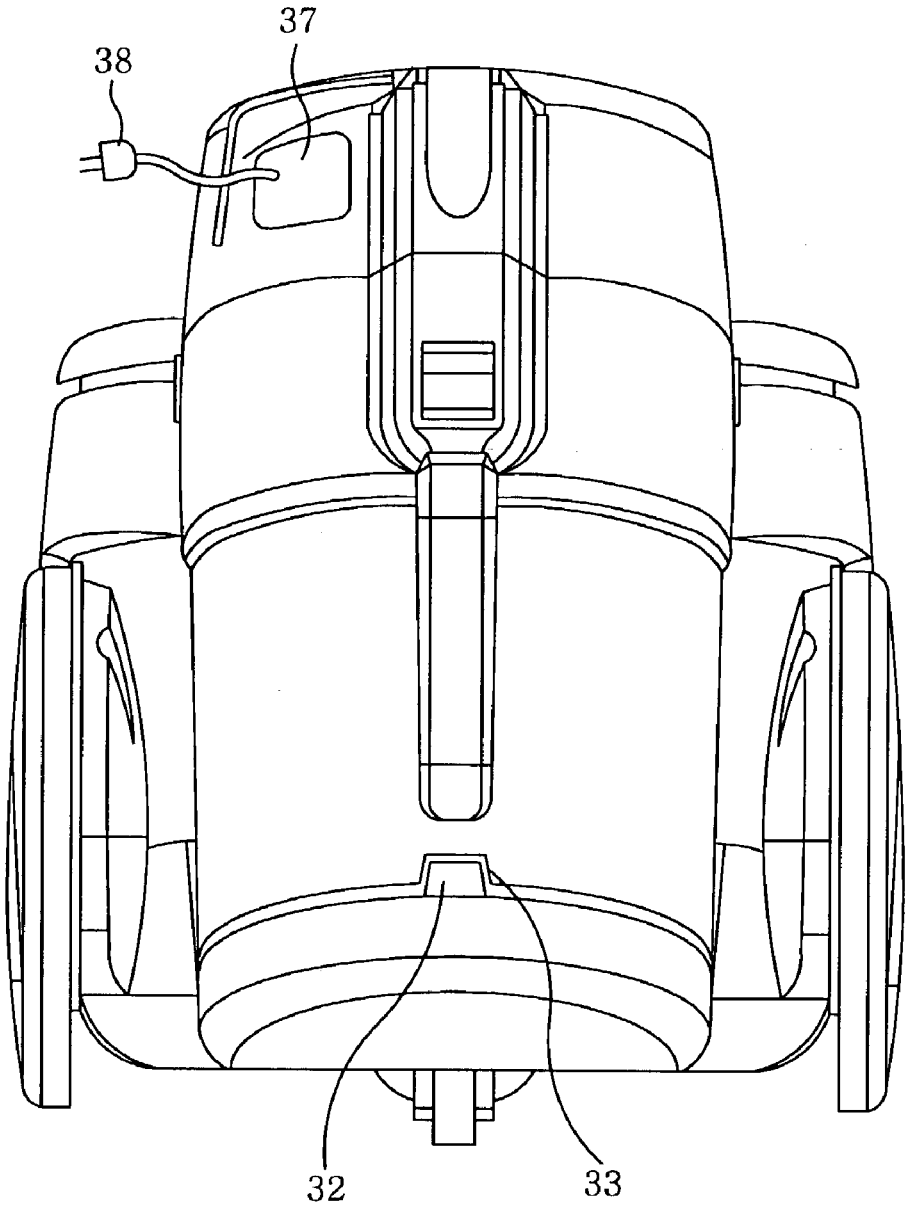
FIG. 3 shows a rear elevational view of the main body of the vacuum cleaner.
Figure 4:
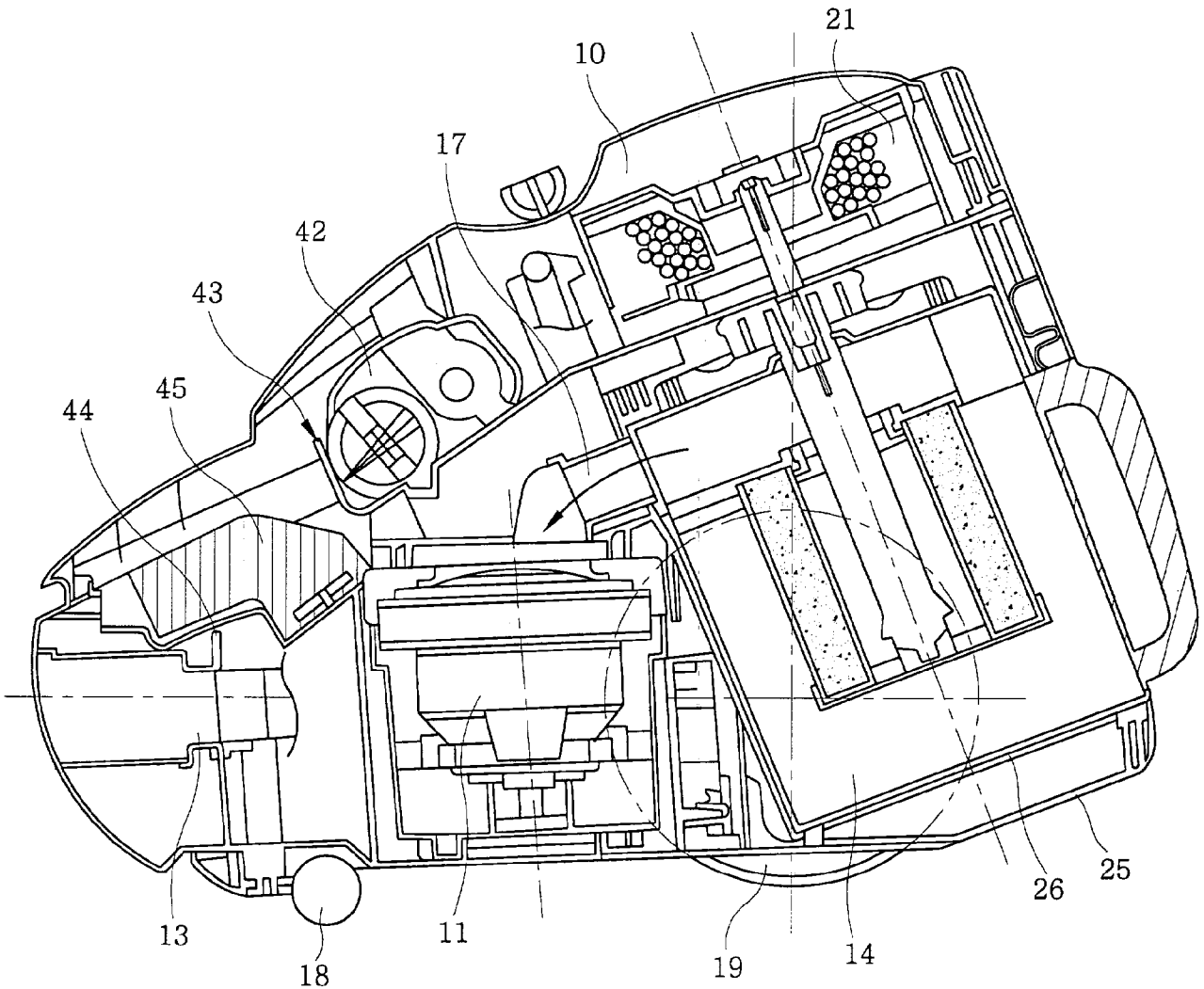
FIG. 4 offers a cross sectional view of the main body of the vacuum cleaner.

Referring to FIGS. 3 and 7, guiding protrusion 32 for guiding the sliding of dust chamber 14 is formed along the length direction of main body 10 on pedestal 26 of support 25 that supports the bottom surface of dust chamber 14. In a corresponding manner, guiding groove 33 is formed on a bottom face of dust chamber 14 in a manner of facing guiding protrusion 32, so that guiding groove 33 can slidably move along guiding protrusion 22, thereby enabling dust chamber 14 to be smoothly loaded into and unloaded from main body 10 and suppressing loose movement of dust chamber 14 in main body 10.

Figure 8:
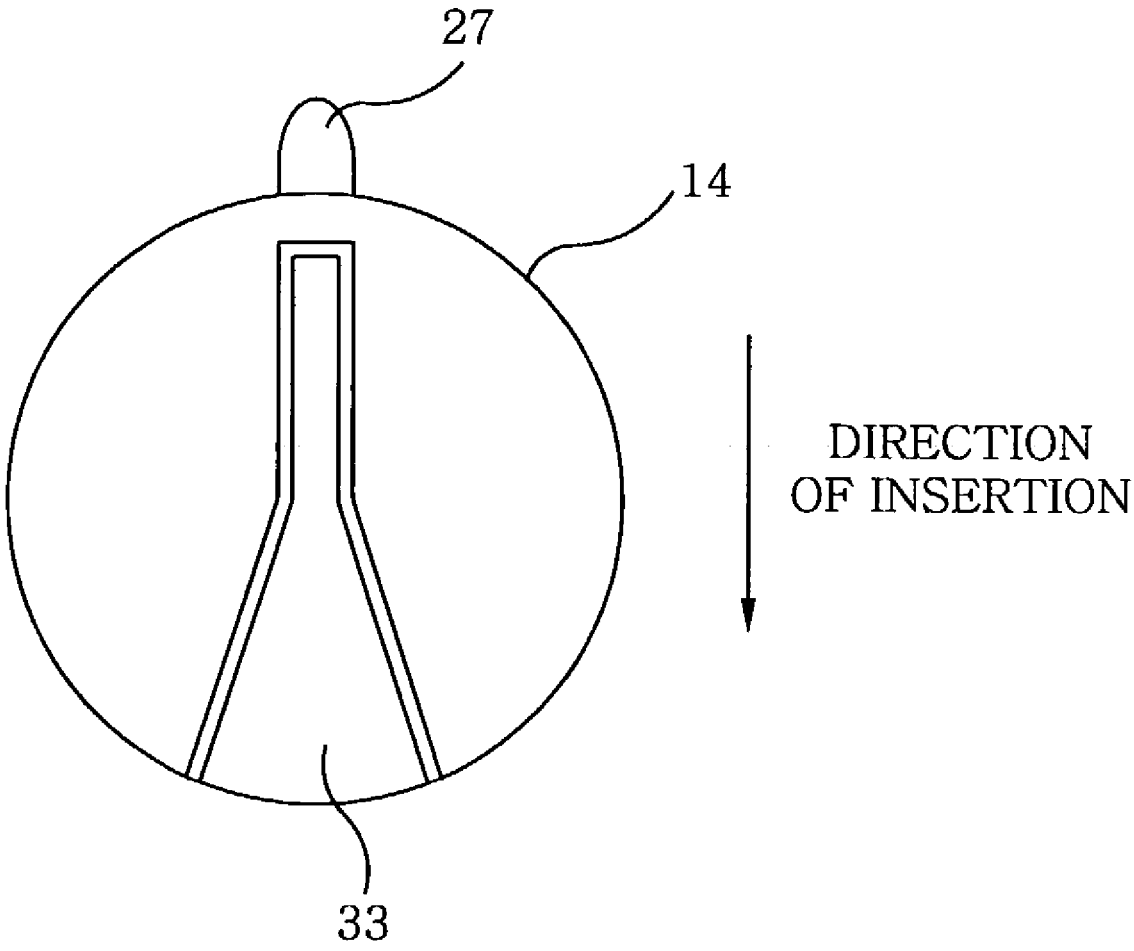
FIG. 8 depicts a bottom view of a dust chamber of the vacuum cleaner.

Furthermore, guiding protrusion 32 is tapered, i.e., gets wider roughly from the center thereof toward the front (along the inserting direction of dust chamber 14), and gradually narrows in the upper direction, forming a trapezoidal cross section. There is provided a small clearance between guiding protrusion 32 and its corresponding guiding groove 33 formed at the bottom surface of dust chamber 14. As shown in FIG. 8, guiding groove 33 provided at the bottom surface of dust chamber 14 widens roughly from the center thereof along the inserting direction of dust chamber 14 and narrows in the upper direction, thereby generally forming a trapezoidal cross section. In particular, the maximum width of guiding groove 33 is equal to or greater than the value of twice the minimum width thereof.

As shown in FIG. 7, dust chamber 14 is formed into base receptacle **14*a* and upper lid 14*b*, in which overlap portion H thereof is set to be greater than the difference between distance L and height h of dust chamber 14, L being the distance between a bottom surface of cord retracting chamber 21 and pedestal 26. Upper lid 14*b* is engaged with base receptacle 14*a*** by means of insertion only.

By placing dust chamber 14 in the rear portion of main body 10, loading and unloading of dust chamber 14 can be carried out without interference with components of the vacuum cleaner, such as hose 12 connected with suction air inlet 13 in the front portion of main body 10, thereby facilitating placing of the dust chamber into and out of main body 10. In addition, by having a downward slant of pedestal 26 toward the front thereof and joining pedestal 26 with the rear wall of main body 10, the loading and unloading of dust chamber 14 into and out of main body 10 becomes further facilitated.

As another added advantage, guiding protrusion 32 and corresponding groove 33 formed in pedestal 26 and dust chamber 14, respectively, assist in securely loading and unloading dust chamber 14 into and from a designated portion of main body 10.

As described above, tapered guiding protrusion 32 gets wider from around the center toward the front of pedestal 26 (in the direction of insertion of dust chamber 14) and gradually narrows in the upper direction to form a generally trapezoidal cross section and the bottom surface of dust chamber 14 is provided with guiding groove 33 formed corresponding to guiding protrusion 32 with certain clearance. Therefore, positioning of dust chamber 14 when being set against pedestal 26 for the restoration thereof can be readily accomplished by simply mating narrow portion of guiding protrusion 32 with the wide portion of guiding groove 33, and then by simply sliding dust chamber 14 into main body 10, dust chamber 14 can be self-aligned to put into the correct sitting position, adding greater convenience.

Figure 9:
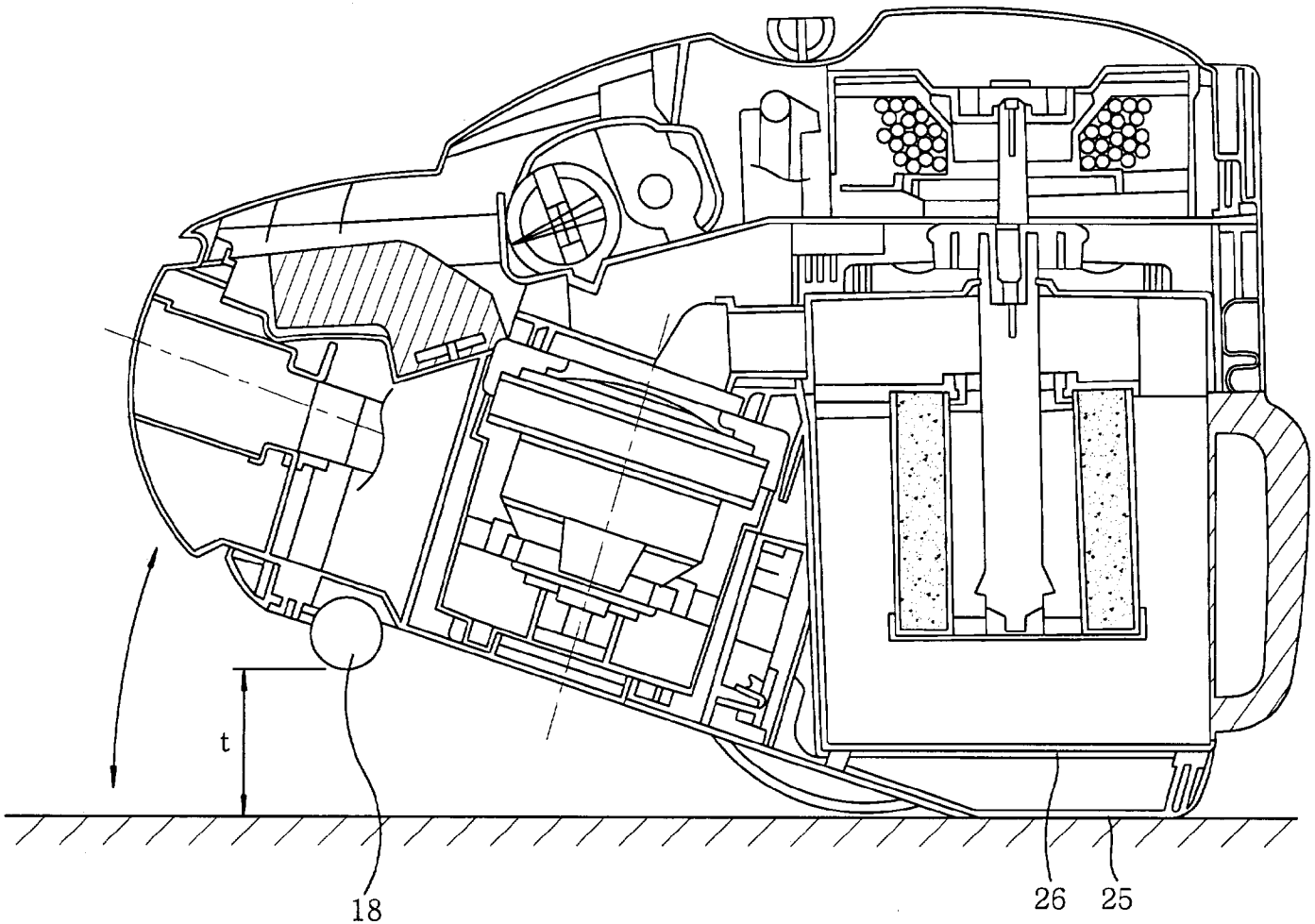
FIG. 9 represents an operational view of the vacuum cleaner when a front portion thereof is lifted.

Referring to FIG. 9, when the front of main body 10 is lifted, support 25, which is located at the back thereof and having the bottom whose rear portion is inclined away from the floor, is in contact therewith, thereby restricting distance t between swivel caster 18 and the floor at the time of lifting the front side of main body 10 to be small. Thus, the impact from dropping the front side of main body 10 from the above-mentioned elevated position is reduced and damages associated therewith are reduced or prevented.

Figure 10:
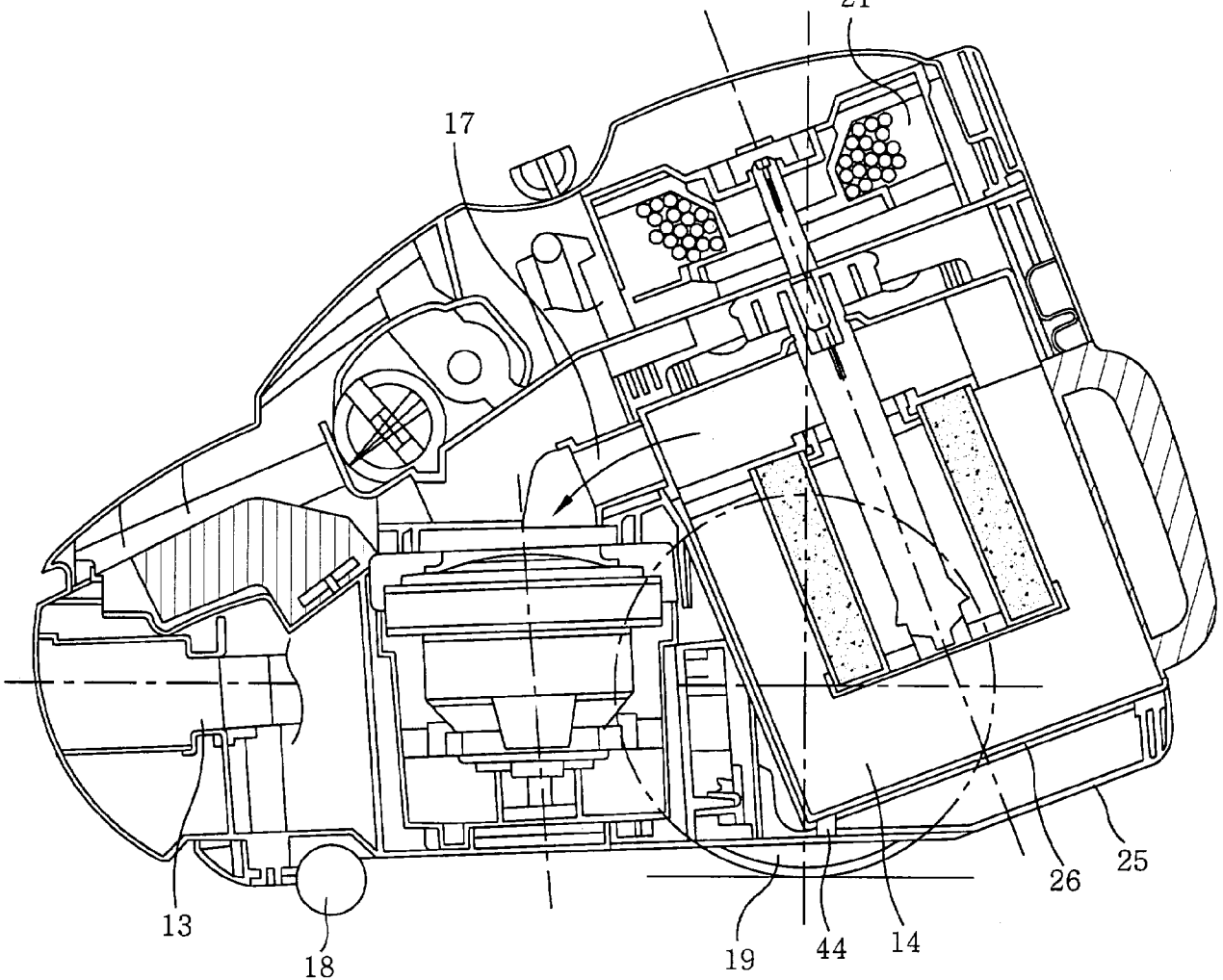
FIG. 10 sets forth a cross sectional side view of a main body of a vacuum cleaner in accordance with a second preferred embodiment of the present invention.

FIG. 10 illustrates a second preferred embodiment in accordance with the present invention, wherein opening 44 that communicates with the outside of the bottom portion of main body 10 is provided near the lowest section of pedestal 26. Under such configuration, dust that may come to being on pedestal 26 can be released to the outside of the machine through opening 44. Thus, difficulty in operability that may otherwise incur due to the dust between dust chamber 14 and pedestal 25 can be substantially prevented.

Figure 11:
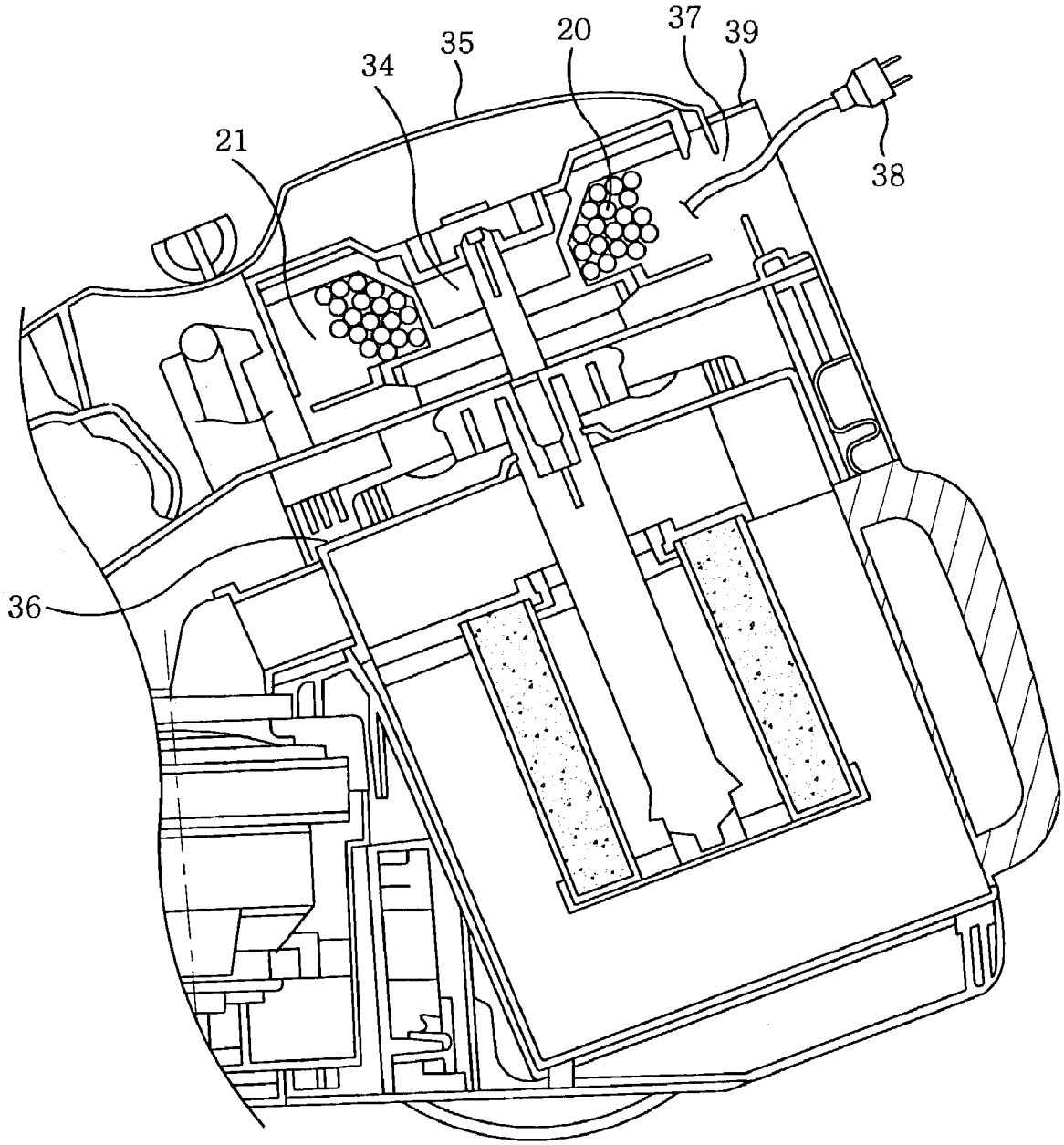
FIG. 11 describes a partial cross sectional view of a rear portion of a main body of the vacuum cleaner in accordance with a third preferred embodiment of the present invention.
Figure 12:
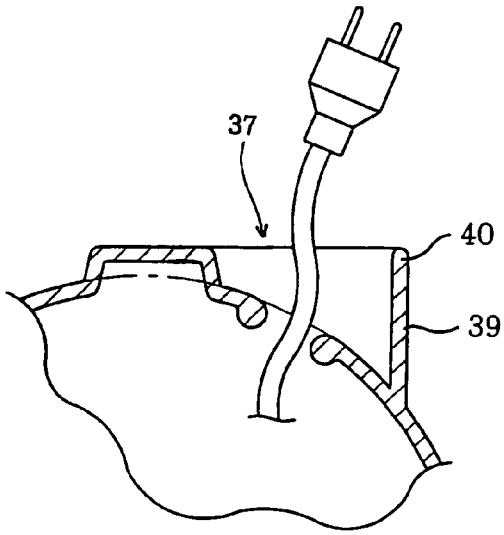
FIG. 12 illustrates a cross sectional view of a cord release opening of a main body of a vacuum cleaner of the present invention.
Figure 13:
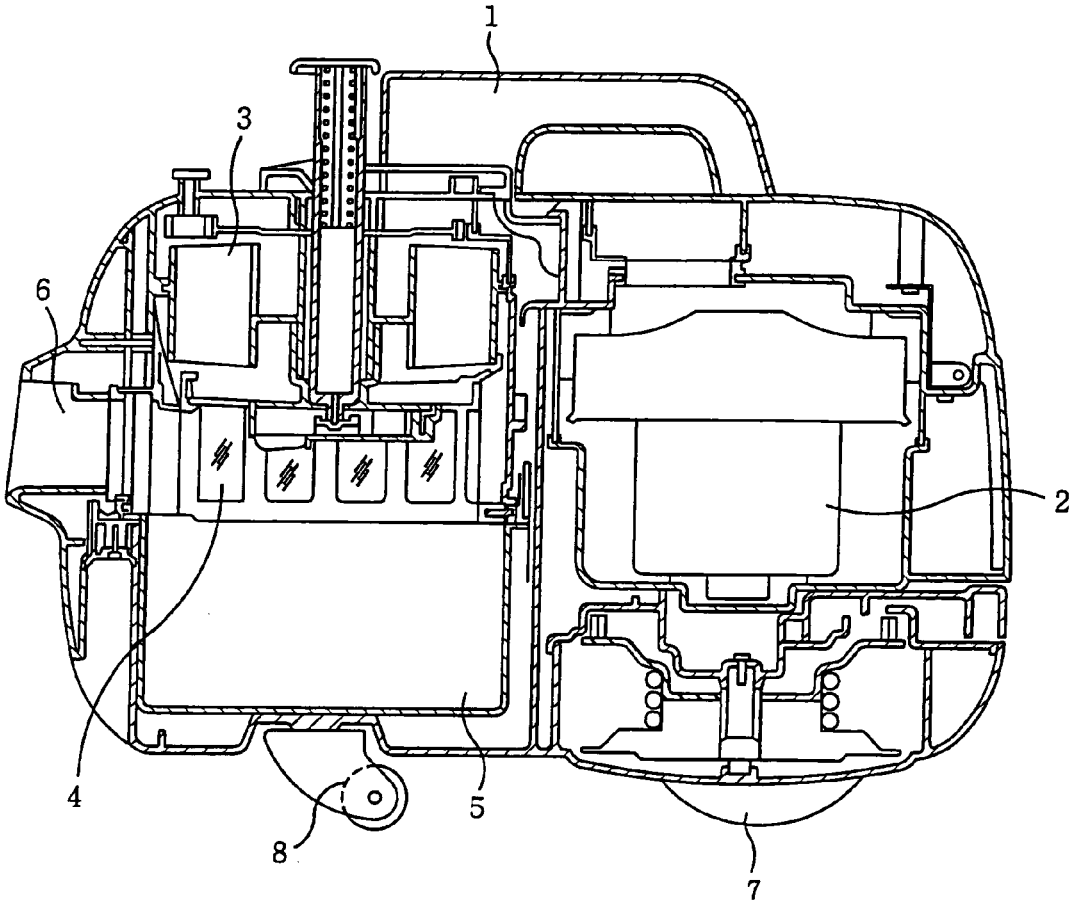
FIG. 13 (PRIOR ART)
FIG. 13 offers a cross sectional side view of a main body of a prior art vacuum cleaner.

FIG. 11 presents a cross sectional view of a rear portion of the vacuum cleaner in accordance with a third preferred embodiment of the present invention. And FIG. 12 represents a cross sectional view of cord release outlet 37, which illustrates in detail the arrangement around cord retracting chamber 21 of the third preferred embodiment. Like parts from the first preferred embodiment will be designated with like reference numerals and a detailed description thereof will be omitted.

Figure 2:
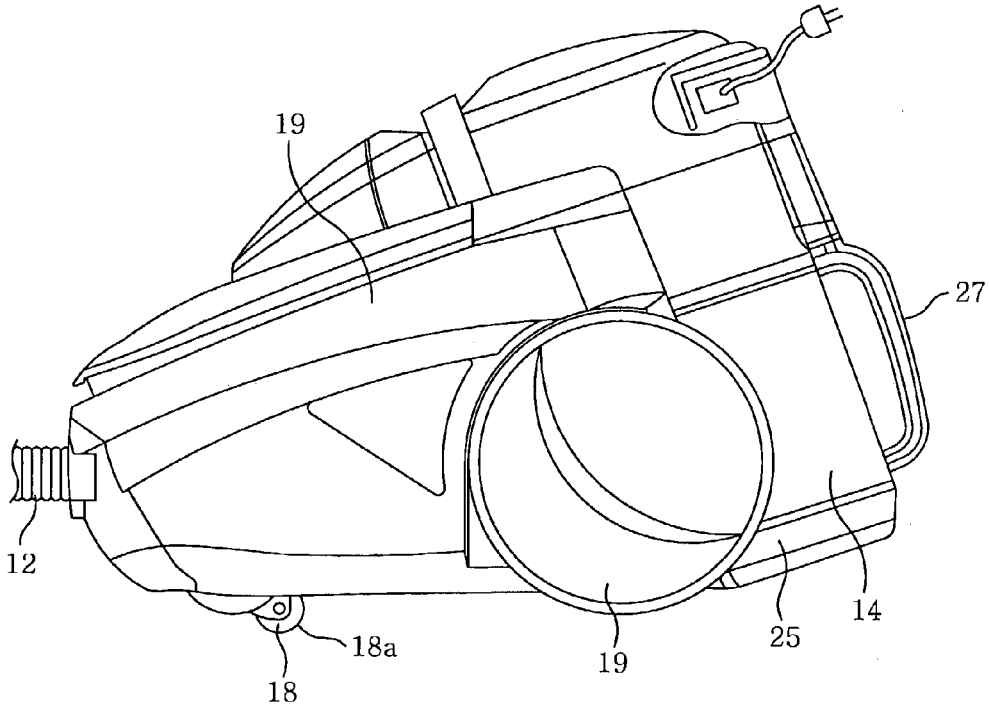
FIG. 2 describes a partially cutaway side elevational view of the main body of the vacuum cleaner.

Referring to FIGS. 2, 11, and 12, cord 20 coupled to cord retracing device 34 is embedded in cord retracting chamber 21 disposed above dust chamber 14. Cord retracting chamber 21 is enclosed by cord reel cover 35 that covers the top surface and the lateral side of cord 20 wound around cord retracting device 34 and further enclosed by partition 36 that separates cord retracting chamber 21 and dust chamber 14. Formed in the rear of cord reel cover 35 is cord release outlet. 37 for releasing cord 20 therethrough. Cord release outlet 37 is upwardly inclined with respect to the floor.

Hereinafter, an operation of the above-described vacuum cleaner will be explained in detail. Plug 38 of cord 20 is easily visible to the user since plug 38 is also inclined upwardly, and further, cord 20 can be easily extracted from and retracted to cord release outlet 37 since plug 38 is disposed in the upper region of main body 10, adding greater convenience.

Seamlessly formed with cord reel cover 35 is guide wall 39. Guide wall 39 is of a protruding structure surrounding plug 38 on the exterior of main body 10 around cord release outlet 37. Under such configuration, guide wall 39 prevents the prongs of plug 38 from damaging the floor, when main body 10 is overturned. The seamless design of guiding wall 39 enables to prevent such damages caused by the prongs, without increasing the number of parts.

Further, by forming guiding wall 39 on main body 10 only to cover the upper and the lateral sides of the plug 38, whiplash created in the upper and lateral direction while retracting cord 20 can be minimized, thereby preventing injuries associated therewith.

Moreover, as illustrated in FIG. 12, by forming end portion 40 of guiding wall 39 that is protruding from cord release outlet 37 in a shape of a circular arc, friction or wear of cord 20 during the retraction thereof is reduced, to thereby improve durability of cord 20.

While the invention has been shown and described with respect to the preferred embodiment, it will be understood to those skilled in the art that various changes and modifications may be made without departing from the spirit and scope of the invention as defined in the following claims.

What is claimed is:

1. A vacuum cleaner, comprising:

an electric blower for generating suction air stream;

a suction air inlet placed in front of the electric blower serving as an inlet of the suction air stream into a main body;

a detachable dust chamber disposed to the rear of the electric blower;

a swivel caster and wheels for transporting the main body; and a pedestal for supporting a bottom surface of the dust chamber, wherein the swivel caster is placed in front of the electric blower, and the pedestal has a descending slant toward the suction air inlet.

2. The vacuum cleaner of claim 1, wherein an axis of rotation of the wheels is directed toward lateral sides of the dust chamber.

3. The vacuum cleaner of claim 2, further comprising:

a cord retracting chamber placed above the dust chamber for storing therein an electrical power cord, wherein the cord retracting chamber has a descending slant toward the suction air inlet.

4. The vacuum cleaner of claim 2, further comprising:

a support under the pedestal, wherein a bottom of the support includes a descending slant toward the suction air inlet to allow the support to get in touch with a surface on which the main body resides when a front portion of the main body is lifted.

5. The vacuum cleaner of claim 2, wherein the axis of rotation of the wheels is located in front of a center of mass of the dust chamber.

6. The vacuum cleaner of claim 1, further comprising:

a cord retracting chamber placed above the dust chamber for storing therein an electrical power cord, wherein the cord retracting chamber has a descending slant toward the suction air inlet.

7. The vacuum cleaner of claim 1, further comprising:

a support under the pedestal, wherein a bottom of the support includes a descending slant toward the suction air inlet to allow the support to get in touch with a surface on which the main body resides when a front portion of the main body is lifted.

8. The vacuum cleaner of claim 1, wherein the dust chamber is made of a transparent or a semi-transparent material.

9. A vacuum cleaner, comprising:

a main body including an electric blower for generating suction air stream;

a dust chamber placed behind the electric blower, forming at least a part of a rear outer perimeter of the main body;

a suction air inlet placed in front of the electric blower serving as an inlet of the suction air stream into the main body; and a pedestal formed in a rear portion of the main body and having a descending slant toward the suction air inlet, wherein the bottom surface of the dust chamber is detachably supported on the pedestal.

10. The vacuum cleaner of claim 9, wherein the dust chamber is made of a transparent or a semi-transparent material.

11. The vacuum cleaner of claim 9, wherein the pedestal is joined with a rear outer wall that forms the rear of the main body.

12. The vacuum cleaner of claim 9, wherein one of the pedestal and the dust chamber has a protrusion and the other thereof has a groove into which the protrusion is inserted.

* * * * *